US011171411B2

(12) United States Patent
Xu et al.

(10) Patent No.: US 11,171,411 B2
(45) Date of Patent: Nov. 9, 2021

(54) BASE STATION ANTENNA

(71) Applicant: Kunshan Luxshare RF Technology Co., Ltd., Suzhou (CN)

(72) Inventors: WenKai Xu, Suzhou (CN); ChengYu Xu, Suzhou (CN); ZhenHua Li, Suzhou (CN); ZhengGuo Zhou, Suzhou (CN); Lu Chen, Suzhou (CN); WanQiang Zhang, Suzhou (CN); MengYun Gu, Suzhou (CN)

(73) Assignee: KUNSHAN LUXSHARE RF TECHNOLOGY CO., LTD., Suzhou (CN)

( * ) Notice: Subject to any disclaimer, the term of this patent is extended or adjusted under 35 U.S.C. 154(b) by 0 days.

(21) Appl. No.: 16/989,278

(22) Filed: Aug. 10, 2020

(65) Prior Publication Data

US 2021/0210840 A1 Jul. 8, 2021

(30) Foreign Application Priority Data

Jan. 3, 2020 (CN) ..... 202020010544.7

(51) Int. Cl.

| | |
|---|---|
| ***H01Q 21/26*** | (2006.01) |
| ***H01Q 1/24*** | (2006.01) |
| ***H01Q 1/38*** | (2006.01) |
| ***H01Q 21/08*** | (2006.01) |
| *H01Q 21/24* | (2006.01) |
| *H01Q 1/48* | (2006.01) |

(52) U.S. Cl.

CPC ..... *H01Q 1/246* (2013.01); *H01Q 1/38* (2013.01); *H01Q 21/08* (2013.01); *H01Q 21/26* (2013.01); *H01Q 1/48* (2013.01); *H01Q 21/24* (2013.01)

(58) Field of Classification Search

CPC ..... H01Q 1/246; H01Q 1/38; H01Q 21/08; H01Q 21/26; H01Q 1/48; H01Q 21/24

See application file for complete search history.

(56) References Cited

U.S. PATENT DOCUMENTS

2020/0099128 A1* 3/2020 Yu ..... H01Q 1/246

FOREIGN PATENT DOCUMENTS

| | | |
|---|---|---|
| CN | 105896071 A | 8/2016 |
| CN | 107069197 A | 8/2017 |

* cited by examiner

*Primary Examiner* — Joseph J Lauture

(74) *Attorney, Agent, or Firm* — Birch, Stewart, Kolasch & Birch, LLP

(57) ABSTRACT

The present disclosure provides a base station antenna comprising a balun support component and a substrate. The balun support component comprises a ground circuit and a balun circuit comprising a plurality of bending parts and a plurality of connecting parts which are alternately connected. Each bending part comprises two wires extending in opposite directions and a bending wire connecting the two wires. The substrate comprises a first surface and a second surface opposite to the first surface. The second surface of the substrate is disposed on the balun support component. The first surface comprises an oscillator arm comprising a first end and a second end. The first end is closer to the center of the substrate than the second end. The second surface comprises a metal ring. The balun circuit and the ground circuit are electrically connected to the oscillator arm.

14 Claims, 10 Drawing Sheets

BASE STATION ANTENNA

CROSS REFERENCE TO RELATED APPLICATION

This application claims the priority benefit of Chinese Patent Application Serial Number CN202020010544.7, filed on Jan. 3, 2020, the full disclosure of which is incorporated herein by reference.

BACKGROUND

Technical Field

The present disclosure relates to the technical field of communication technology, and more particularly to a base station antenna.

Related Art

The base station antenna is a vital connection for mobile communication equipment in the prior arts. The quality and performance of the base station antenna indeed affect the quality and user experience of mobile communication. With the development of the current communication technology, the location of the base station would have influenced the quality of mobile communication. The base station antenna couples with a ¼ wavelength metal feed sheet by a metal die-casting radiator to radiate. However, the size of current base station antennas is too large to be installed, which is not suitable for the current market demand for 4G and 5G low profile antenna.

SUMMARY

The embodiments of the present disclosure provide a base station antenna intended to solve the issue that the current size of base station antennas is too large to be installed, which is not suitable for the current market demand for 4G and 5G low profile antenna.

The present disclosure provides a base station antenna comprising a balun support component and a substrate. The balun support component comprises a ground circuit and a balun circuit comprising a plurality of bending parts and a plurality of connecting parts that are alternately connected. Each bending part comprises two wires extending in opposite directions and a bending wire connecting the two wires extending in opposite directions. The substrate comprises a first surface and a second surface opposite to the first surface. The second surface of the substrate is disposed on the balun support component. The first surface comprises an oscillator arm comprising a first end and a second end. The first end is closer to a center of the substrate than the second end. The second surface comprises a metal ring. The balun circuit and the ground circuit are electrically connected to the oscillator arm.

The base station antenna of the present disclosure is provided. The balun circuit is disposed on the support surface of the balun support component in a multiple bending configuration to make the circuit layout of the balun circuit concentrated, which reduces the length and width of the support surface of the balun support component required for the disposing of the balun circuit, and could also reduce the height of the balun support component to satisfy the requirements of low profile antenna.

It should be understood, however, that this summary may not contain all aspects and embodiments of the present invention, that this summary is not meant to be limiting or restrictive in any manner, and that the invention as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
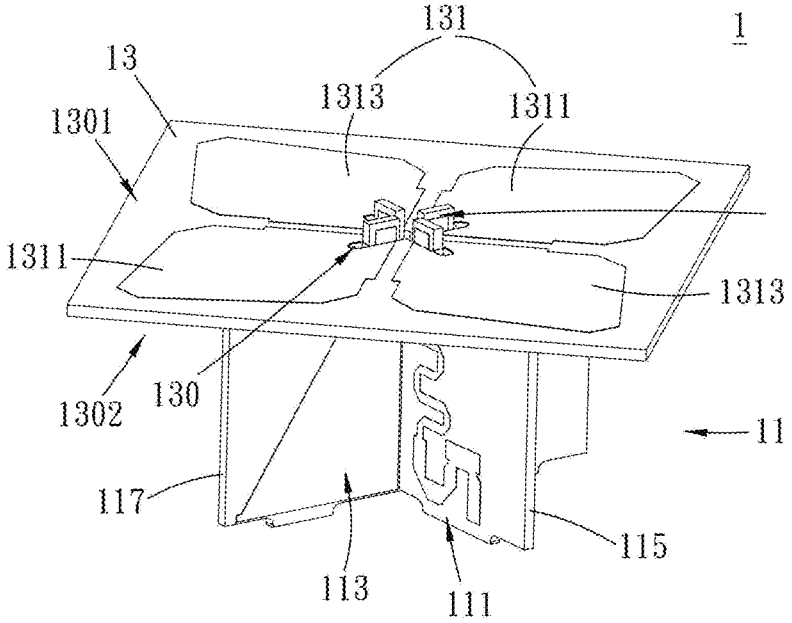
FIG. 1 is a perspective view of a base station antenna of the first embodiment of the present disclosure.

The present invention will now be described more fully hereinafter with reference to the accompanying drawings, in which exemplary embodiments of the invention are shown. This present invention may, however, be embodied in many different forms and should not be construed as limited to the embodiments set forth herein. Rather, these embodiments are provided so that this present invention will be thorough and complete, and will fully convey the scope of the present invention to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the invention. This description is made for the purpose of illustration of the general principles of the invention and should not be taken in a limiting sense. The scope of the invention is best determined by reference to the appended claims.

Moreover, the terms "include", "contain", and any variation thereof are intended to cover a non-exclusive inclusion. Therefore, a process, method, object, or device that comprises a series of elements not only include these elements, but also comprises other elements not specified expressly, or may include inherent elements of the process, method, object, or device. If no more limitations are made, an element limited by "include a/an . . . " does not exclude other same elements existing in the process, the method, the article, or the device which comprises the element.

In the following embodiment, the same reference numerals are used to refer to the same or similar elements throughout the invention.

Figure 2:
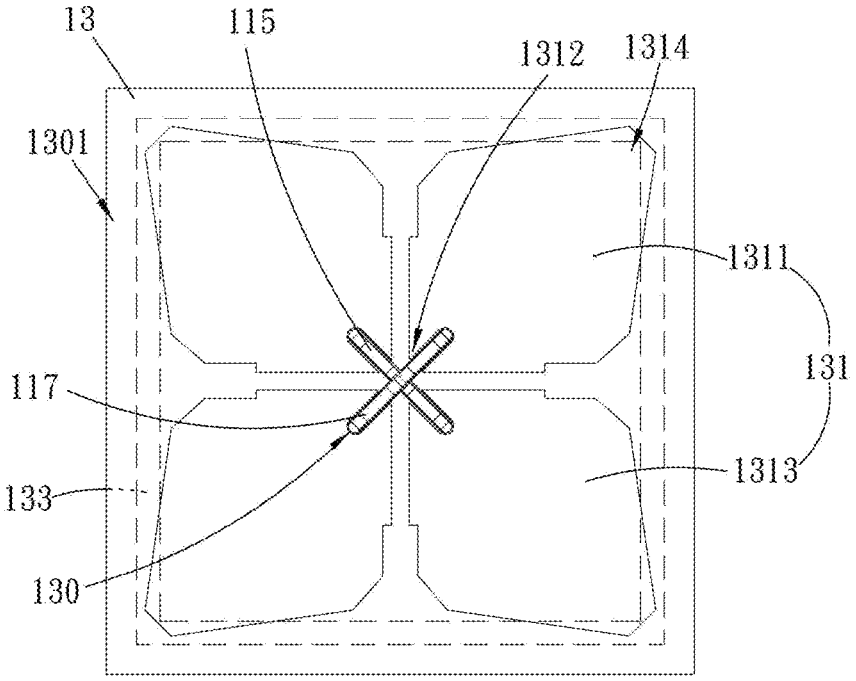
FIG. 2 is a top view of a base station antenna of the first embodiment of the present disclosure.
Figure 3:
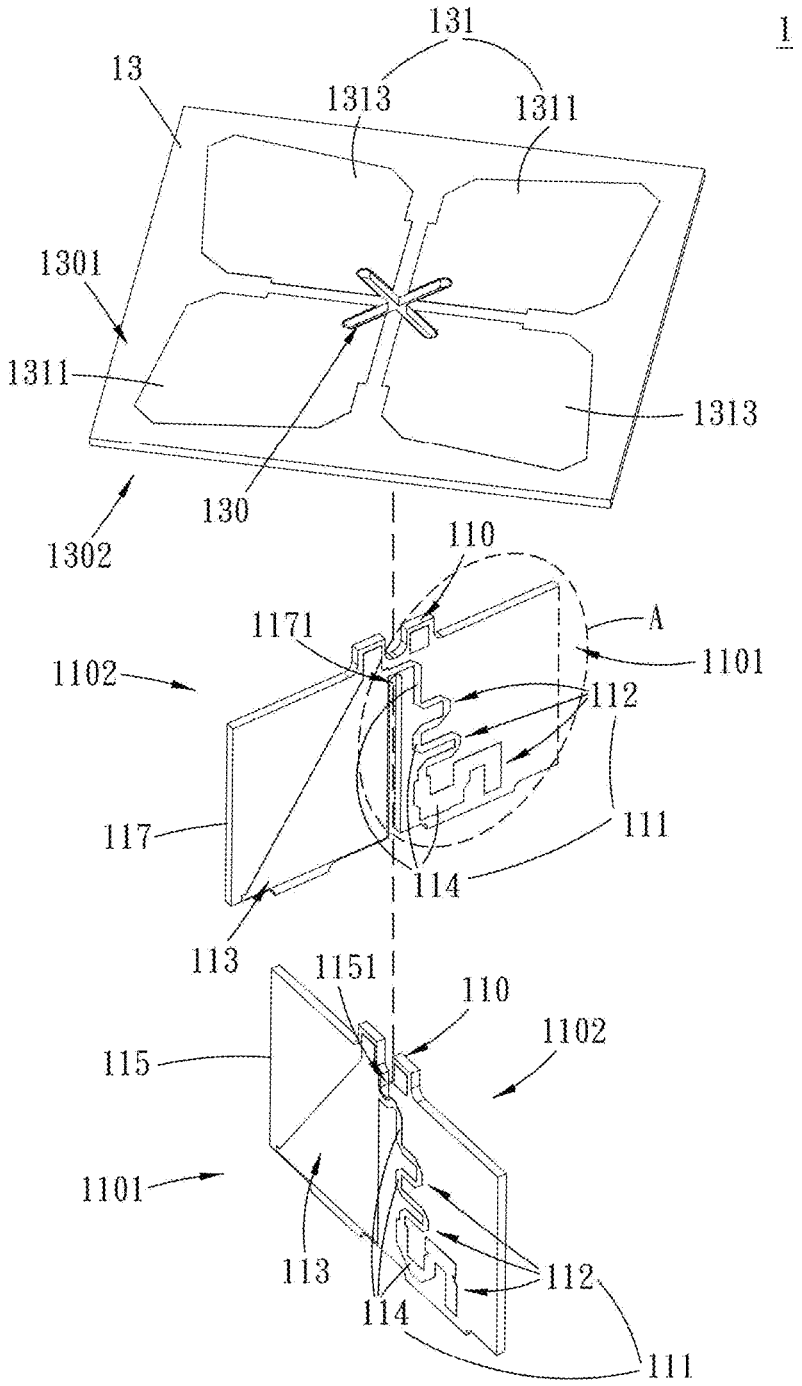
FIG. 3 is an exploded view of a base station antenna of the first embodiment of the present disclosure.

FIG. 1 to FIG. 5 are a perspective view, a top view, exploded views and an enlarged view of area A in FIG. 3. As shown in the figures, the present disclosure provides a base station antenna 1 used as an equipment for communication connection for mobile communication devices. In the present disclosure, the base station antenna 1 further comprises a balun support component 11 and a substrate 13.

In this embodiment, the balun support component 11 comprises a ground circuit 113 and a balun circuit 111. The balun circuit 111 comprises a plurality of bending parts 112 and a plurality of connecting parts 114 which are alternately connected. Each bending part 112 comprises two wires extending in opposite directions and a bending wire connecting the two wires extending in opposite directions. The substrate 13 comprises a first surface 1301 and a second surface 1302 opposite to the first surface 1301. The second surface 1302 of the substrate 13 is disposed on the balun support component 11. The first surface 1301 comprises an oscillator arm 131 comprising a first end 1312 and a second end 1314. The first end 1312 is closer to the center of the substrate 13 than the second ends 1314. The second surface 1302 comprises a metal ring 133. The balun circuit 111 and the ground circuit 113 are electrically connected to the oscillator arm 131. The electrical connection may be direct (such as physical connection) or indirect (such as electrical coupling).

Refer to FIG. 2 again, the substrate 13 is square-shaped, and the number of the oscillator arm 131 is four. The substrate 13 is a printed circuit board. The four oscillator arms 131 are metal layers printed on the substrate 13. The four oscillator arms 131 comprise two first oscillator arms 1311 and two second oscillator arms 1313. The two first oscillator arms 1311 and the two second oscillator arms 1313 are circularly arranged around the center of the substrate 13. The two first oscillator arms 1311 are oppositely disposed. The two second oscillator arms 1313 are oppositely disposed. The two first oscillator arms 1311 and the two second oscillator arms 1313 are orthogonally arranged on the substrate 13 at a ±45 degrees and are disposed corresponding to four right-angled ends of the substrate 13 making polarized orthogonality of the two first oscillator arms 1311 and the two second oscillator arms 1313. Each oscillator arm 131 is rhombus-shaped. The first end 1312 of each oscillator arm 131 is close to the center of the substrate 13. The first end 1312 is a feeding end. The second end 1314 of each oscillator arm 131 is away from the center of the substrate 13. The second end 1314 is a termination end. There is a gap between every two adjacent oscillator arms 131. The gaps form a strong coupling conducive to the implementation of two orthogonal polarizations.

In this embodiment, the metal ring 133 may be a closed circular ring body or a closed rectangular ring body. The metal ring 133 surrounds and crosses the four edges of the substrate 13. While the oscillator arms 131 are projected onto the second surface 1302 forming projection areas, the projection areas partially overlap with the metal ring 133. As shown in FIG. 2, the second ends 1314 of the oscillator arms 131 overlap with the metal ring 133 on the projection plane parallel to the second surface 1302. The metal ring 133 is coupled to the oscillator arms 131. The circumference of the metal ring 133 is about one wavelength of the broadened frequency band. The wavelength could range from 80 to 125 mm, but not limited to this range. The overlapping area of the projection between the metal ring 133 and the of the oscillator arm 131 can guide the current of the dipole oscillator arm 131 to be in response to the lower metal ring 133, thereby achieving electromagnetic coupling and current path to implement radiation, and increasing the front-to-rear ratio and the cross-polarization ratio of the oscillator arm 131.

Figure 6:
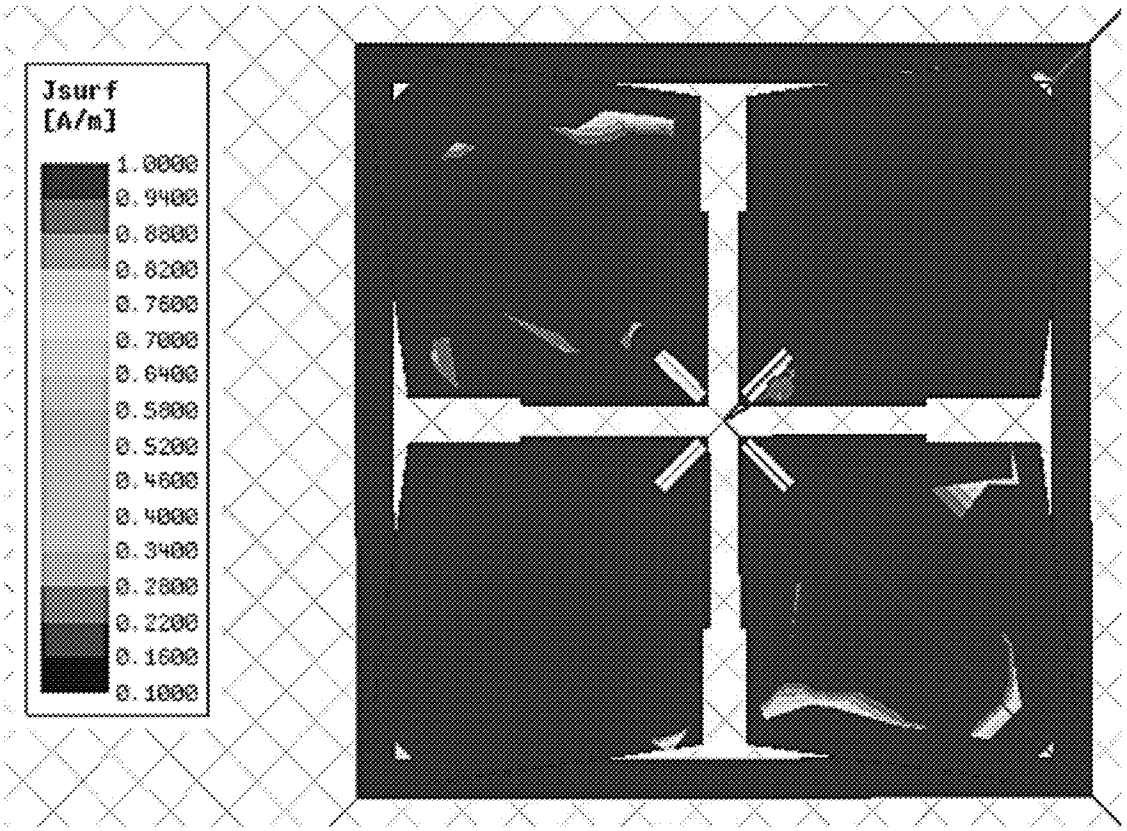
FIG. 6 is an energy map of a base station antenna of the first embodiment of the present disclosure.
Figure 7:
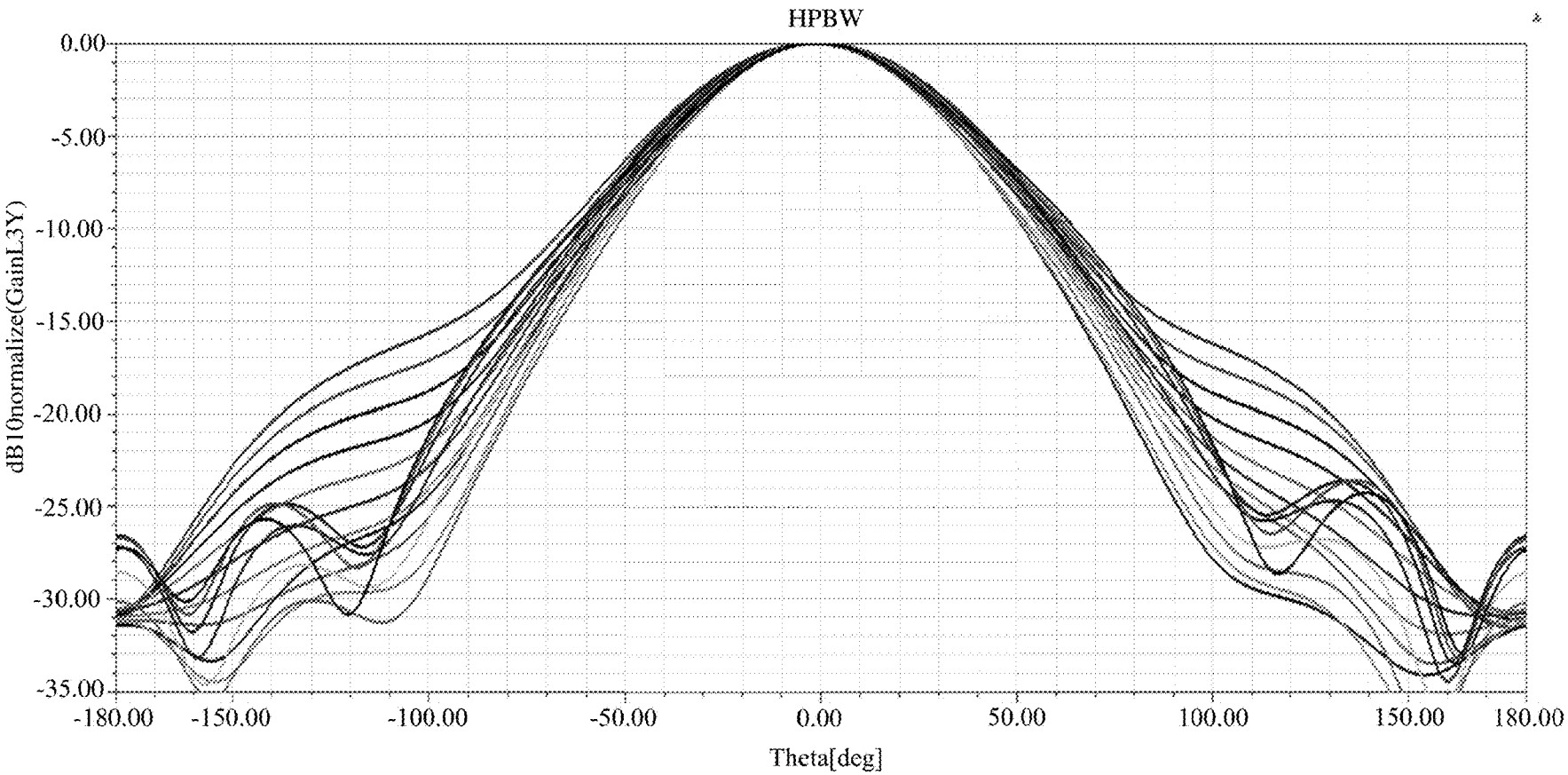
FIG. 7 is a horizontal plane direction energy graph of a base station antenna of the first embodiment of the present disclosure.

FIG. 6 is an energy map of a base station antenna of the first embodiment of the present disclosure. FIG. 7 is a horizontal plane direction energy graph of a base station antenna of the first embodiment of the present disclosure. As shown in the figures, each overlapping area of the projection between the metal ring 133 and each oscillator arm 131 is configured to be identical, realizing the radiation of the dual-polarized oscillator unit to be rotationally symmetric around the center point of the substrate, further achieving the uniformity of two polarization directions at ±45 degrees. The above method presents the effect of lengthening the oscillator arm 131 so that the frequency band of the oscillator arm 131 reaches ¼ of the broadened frequency band. The closing of the metal ring 133 can make the two polarized energy radiations have better consistency after the frequency band is broadened, and the beam width is more convergent at 56 to 66 degrees.

Figure 4:
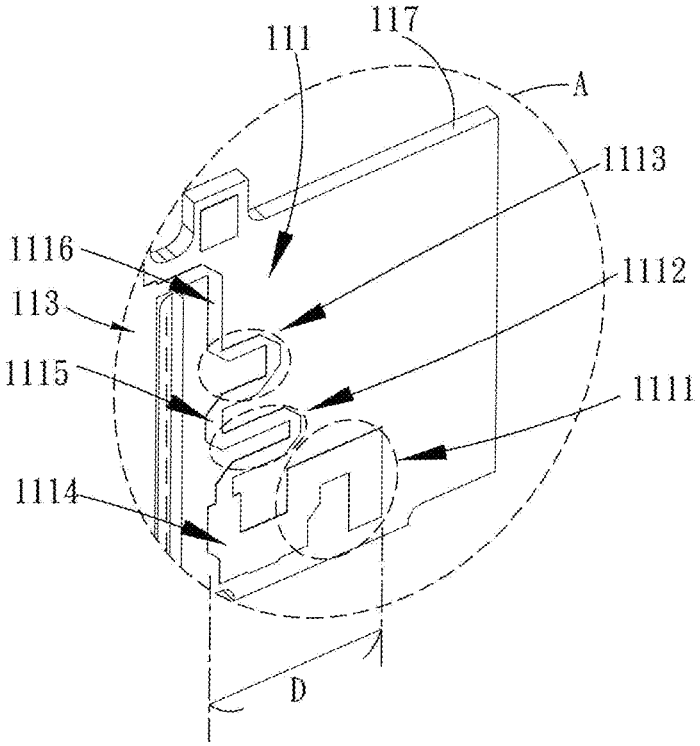
FIG. 4 is an enlarged view of area A in FIG. 3.

Refer to FIG. 3 to FIG. 5 again, in this embodiment, the balun support component 11 comprises a first balun support member 115 and a second balun support member 117. The first balun support member 115 and the second balun support member 117 crosses each other. The first balun support member 115 comprises a first securing notch 1151. The second balun support member 117 comprises a second securing notch 1171. The first securing notch 1151 and the second securing notch 1171 are engaged and secured to each other.

The second surface 1302 of the substrate 13 is disposed on the first balun support member 115 and the second balun support member 117. The first balun support member 115 is disposed below the two opposite first oscillator arms 1311. The second balun support member 117 is disposed below the two opposite second oscillator arms 1313. The first balun support member 115 and the second balun support member 117 respectively comprise a first support surface 1101 and a second support surface 1102 opposite to the first support surface 1101. Each first support surface 1101 comprises the ground circuit 113 and the balun circuit 111 electrically connected to the ground circuit 113. Each second support surface 1102 comprises the ground circuit 113. The plurality of ground circuits 113 of the first balun support member 115 is disposed on two sides relative to the second balun support member 117. The balun circuit 111 of the first balun support member 115 is disposed on one side relative to the second balun support member 117. The plurality of the ground circuits 113 of the second balun support member 117 is disposed on two sides relative to the first balun support member 115. The balun circuit 111 of the second balun support member 117 is disposed on one side relative to the first balun support member 115. On the first balun support member 115, the balun circuit 111 of the first support surface 1101 and the ground circuit 113 of the second supporting surface 1102 are disposed on the same side relative to the second balun support member 117. On the second balun support member 117, the balun circuit 111 of the first support surface 1101 and the ground circuit 113 of the second supporting surface 1102 are disposed on the same side relative to the first balun support member 115.

In addition, the substrate 13 comprises a feeding perforation 130 passing through the first ends 1312 of the oscillator arms 131. The first balun support member 115 and the second balun support member 117 respectively comprise two feeding protrusions 110. The ground circuits 113 are respectively extended to the surfaces of the corresponding feeding protrusions 110. The feeding protrusions 110 passes through the feeding perforation 130. The ground circuits 113 are connected to the corresponding oscillator arms 131.

Refer to FIG. 3 and FIG. 4 again, the balun circuit 111 is a wire with behind parts. The balun circuit 111 comprises a plurality of connecting parts 114 and a plurality of bending parts 112. The lengths of the bending parts 112 are respectively equal to a quarter of a wavelength of an operating center. In this embodiment, the plurality of bending parts 112 comprises a first bending part 1111, a second bending part 1112, and a third bending part 1113. The plurality of connecting parts 114 comprises a first connecting part 1114, a second connecting part 1115, and a third connecting part 1116. The first bending part 1111, the first connecting part 1114, the second bending part 1112, the second connecting part 1115, the third bending part 1113, and the third connecting part 1116 are connected in order. The first bending part 1111 is farther from the substrate 13 than the third bending part 1113 is. The length of the first bending part 1111, the length of the second bending part 1112, and the length of the third bending part 1113 are respectively equal to a quarter of a wavelength of an operating center. In addition, the height of the first balun support member 115 and the height of the second balun support member 117 are respectively less than a quarter of a wavelength of an operating center.

The two wires extending in opposite directions (vertically upward and vertically downward) of the bending parts 112 are spaced from each other and are parallel to each other. The extension direction of the bending wire connecting the two opposite wires is bent from one direction to the opposite direction by 180 degrees. Refer to FIG. 4, the two wires extending in opposite directions of the first bending part 1111 are vertically extended upward and downward. The extending direction of the bending wire connecting the two opposite wires of the first bending part 1111 is bent from the upward direction to the downward direction by 180 degrees, making the bending direction or the direction of the opening formed by the bending of the first bending part 1111 downward. The two wires extending in opposite directions of the second bending part 1112 are horizontally extended to the right and horizontally to the left. The extending direction of the bending wire connecting the two opposite wires is bent from the right direction to the left direction by 180 degrees, making the bending direction or the direction of the opening formed by the bending of the second bending part 1112 towards the left. The third bending part 1113 may be similar to the second bending part 1112. The bending direction or the direction of the opening formed by the bending of the third bending part 1113 is also leftward. In the present embodiment, the vertical gap between the two wires extending in opposite directions of the second bending part 1112 is less than that of the third bending part 1113. The horizontal extension length of the two wires extending in opposite directions of the second bending part 1112 (or horizontal width D of the second bending part 1112) is greater than the horizontal extension length of two wires extending in opposite directions of the third bending part 1113 (or horizontal width D of the third bending part 1113), but is not limited thereto. In the present embodiment, the width of the wire of the first bending part 1111 is greater than the width of the wire of the second bending part 1112 and the width of the wire of the third bending part 1113, but is not limited thereto.

Therefore, the bending direction or the direction of the opening of the first bending part 1111 is different from those of the second bending part 1112. The bending direction or the direction of the opening of the second bending part 1112 and those of the third bending part 1113 are the same. The first bending part 1111 is an inverted U-shaped structure with a downward opening. The second bending part 1112 and the third bending part 1113 are inverted C-shaped structure with leftward openings. The first bending part 1111 is connected to the second bending part 1112 by an L-shaped part of the first connecting part 1114. The second bending part 1112 is connected to the third bending part 1113 by an I-shaped part of the second connecting part 1115. The third bending part 1113 is connected to the ground circuit 113 by an upside-down, left-right reversed L-shaped part of the third connection part 1116. In addition, the horizontal width D of the circuit layout of the balun circuit 113 decreases from one end away from the substrate 13 to one end close to the substrate 13.

Figure 8:
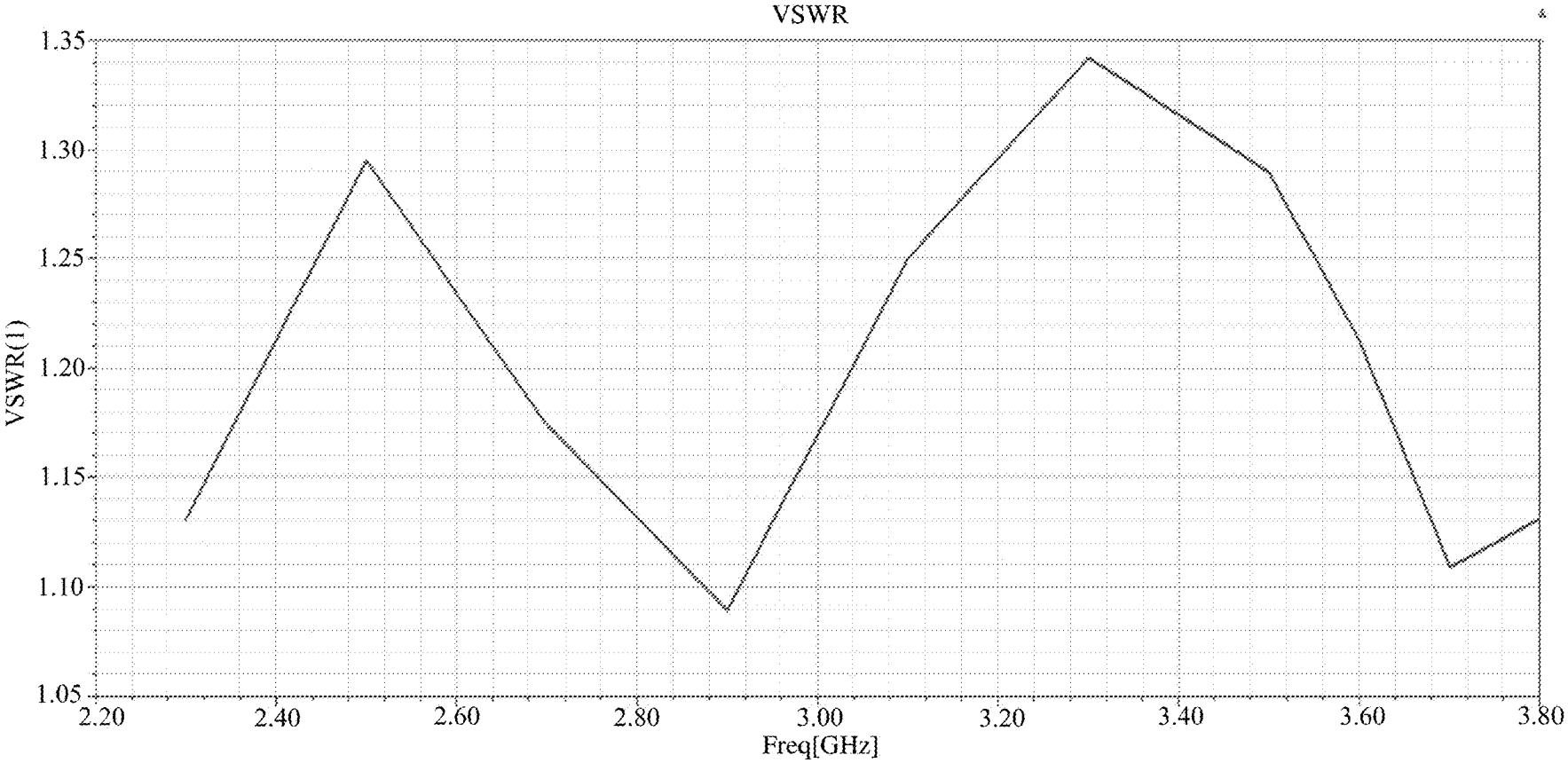
FIG. 8 is a frequency voltage standing wave ratio graph of a base station antenna of the first embodiment of the present disclosure.
Figure 9:
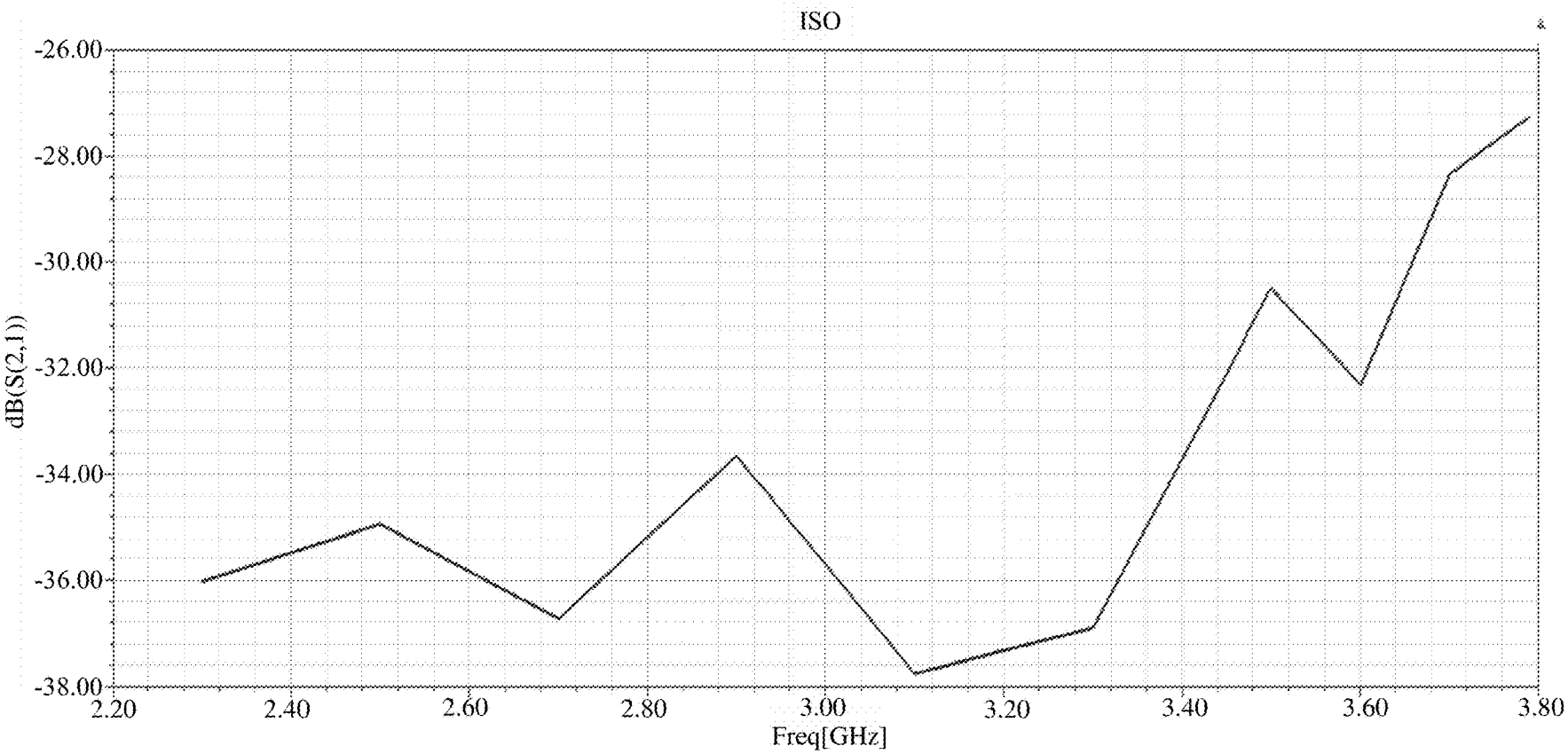
FIG. 9 is a frequency decibel graph of a base station antenna of the first embodiment of the present disclosure.

FIG. 8 is a frequency voltage standing wave ratio graph of a base station antenna of the first embodiment of the present disclosure. FIG. 9 is a frequency decibel graph of a base station antenna of the first embodiment of the present disclosure. As shown in the figures, the balun circuit 113 comprises the first bending part 1111, the second bending part 1112, and the third bending part 1113. The above structure contains three ¼ wavelength impedance matching formation. The first bending part 1111, the second bending part 1112, and the third bending part 1113 of the balun circuit 113 are mainly used for frequency band broadening. The balun circuit 113 is laid in a back-and-forth-bending configuration, so as to not only effectively saves the space for the circuit layout but also efficiently improves the standing wave matching (1.35) and isolation (26 dB).

Figure 5:
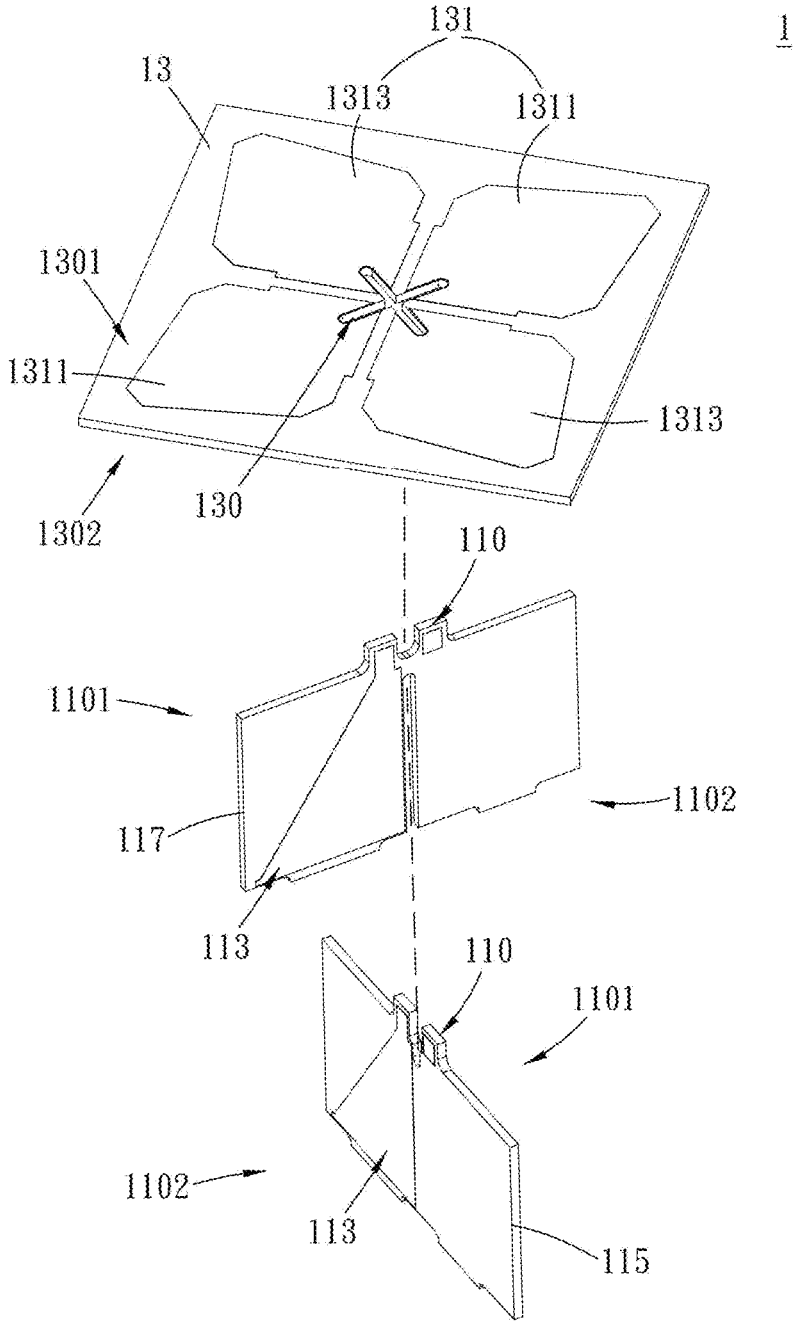
FIG. 5 is another exploded view of a base station antenna of the first embodiment of the present disclosure.
Figure 10:
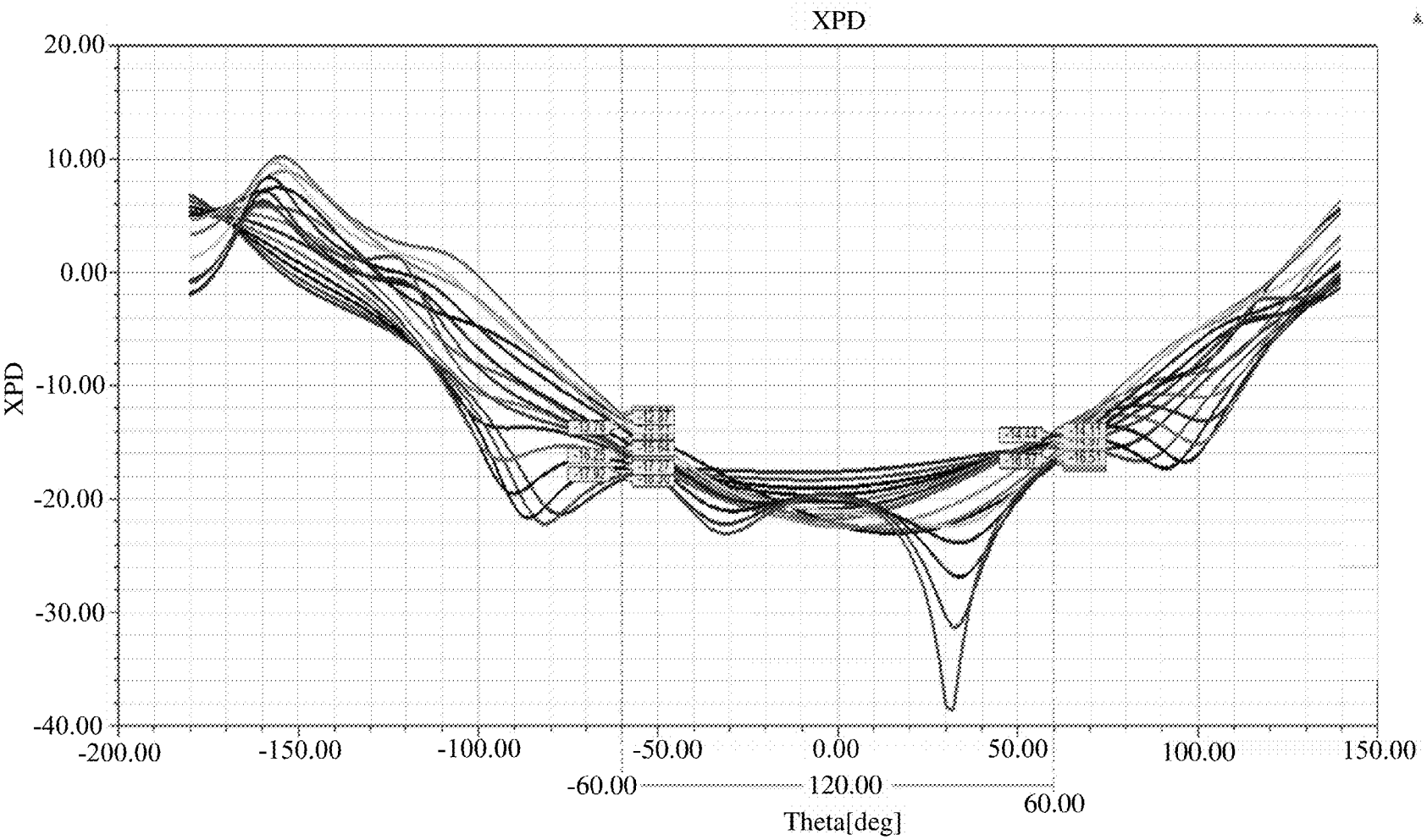
FIG. 10 is a cross polarization ratio simulation graph of a base station antenna of the first embodiment of the present disclosure.

FIG. 10 is a cross polarization ratio simulation graph of a base station antenna of the first embodiment of the present disclosure. In this embodiment, the wire width of the ground circuit 113 decreases from one end away from the substrate 13 to one end close to the substrate 13. An edge of the ground circuit 113 away from the center of the substrate 13 is straight. Refer to FIG. 5, the edge of the ground circuit 113 away from the center of the substrate 13 is an oblique straight line extending from a position close to the outer bottom side of the substrate 13 to a position close to the center top side of the substrate 13, making the overall wiring of the ground circuit 113 a right triangle or a trapezoid. The described ground circuit 113 is configured to increase the cross polarization ratio (17 for axial, and 12 at ±60 degrees) by increasing the lateral current, decreasing the vertical current, and reducing current coupling.

In this embodiment, the base station antenna 1 converges the beam width of the horizontal plane through the metal ring 133, which greatly broadens the operating frequency band of the oscillator arm (2.3 GHZ to 3.8 GHZ). The balun circuit 111 is disposed on the supporting surfaces of the balun support component 11 in a multiple-bending configuration, so that the balun circuit 111 is concentrated in a partial area. In this way, the area that the balun circuit 111 required to be disposed on can be reduced, hence minimizing the entire volume of the balun support component 11. The width of the wire of the ground circuit 113 decreases from one end away from the substrate 13 to one end close to the substrate 13, improving the cross polarization ratio of high-frequency band at horizontal plane axial and at 60 degrees, further enhancing the antenna radiation performance.

Figure 11:
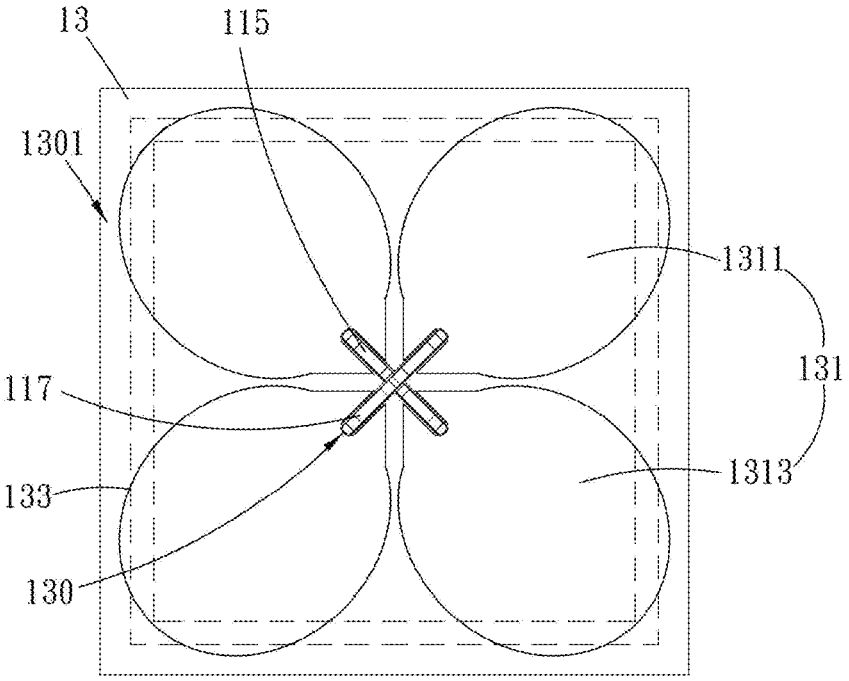
FIG. 11 is a top view of a base station antenna of the second embodiment of the present disclosure.

FIG. 11 is a top view of a base station antenna of the second embodiment of the present disclosure. As shown in the figure, the difference between this embodiment and the first embodiment lies in the shape of the oscillator arms 131. In this embodiment, the oscillator arms 131 are circular and the diameter of the oscillator arms 131 equal to ¼ wavelength. One end of each oscillator arm 131 close to the center of the substrate 13 is protruded. The shape of the oscillator arms 131 is not limited to this embodiment, the oscillator arm can also be rectangular or polygonal, which is adjustable according to requirements.

Figure 12:
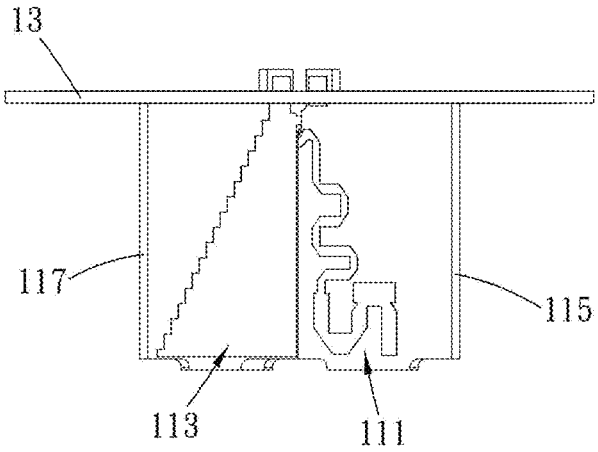
FIG. 12 is a side view of a base station antenna of the third embodiment of the present disclosure.

FIG. 12 is a side view of a base station antenna of the third embodiment of the present disclosure. As shown in the figure, the difference between this embodiment and the first embodiment lies in the pattern of the ground circuits. In the embodiment, the edge of the ground circuit 113 away from the center of the substrate 13 is stepped. The pattern of the edge of the ground circuit 113 away from the center of the substrate 13 is not limited to this embodiment, as long as the decreasing of the width of the ground circuit 113 from one end away from the substrate 13 to one end close to the substrate 13 is satisfied, the effect of this embodiment can be just achieved.

In summary, the present disclosure provides a base station antenna. A balun circuit is disposed on the support surface of a balun support component by in a multiple-bending configuration to make the circuit layout of the balun circuit concentrated, which reduces the length and width of the support surfaces of the balun support component required for the disposing of the balun circuits, and could also reduce the height of the balun support component to meet the requirements of low profile antenna. Furthermore, the substrate and the oscillator arms are produced by the way of circuit board printing to reduce the weight of the product. In addition, the beam width on the horizontal plane is converged by the oscillator arms cooperating with the metal ring to greatly broaden the operating frequency band. The ground circuit is gradually broadened from bottom to top, improving the cross polarization ratio of high-frequency band at horizontal plane axial and at 60 degrees, further improving the antenna radiation performance. The base station antenna of this disclosure can realize the ultra-wideband, high cross polarization, low standing wave, high isolation, and low profile.

It is to be understood that the term "comprises", "comprising", or any other variants thereof, is intended to encompass a non-exclusive inclusion, such that a process, method, article, or device of a series of elements not only include those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present invention has been explained in relation to its preferred embodiment, it does not intend to limit the present invention. It will be apparent to those skilled in the art having regard to this present invention that other modifications of the exemplary embodiments beyond those embodiments specifically described here may be made without departing from the spirit of the invention. Accordingly, such modifications are considered within the scope of the invention as limited solely by the appended claims.

What is claimed is:

1. A base station antenna, comprising:

a balun support component comprising a ground circuit and a balun circuit, the balun circuit comprising a plurality of bending parts and a plurality of connecting parts which are alternately connected, each bending part comprising two wires extending in opposite directions and a bending wire connecting the two wires extending in opposite directions; and a substrate comprising a first surface and a second surface opposite to the first surface, the second surface of the substrate being disposed on the balun support component; the first surface comprising an oscillator arm comprising a first end and a second end, the first end being closer to a center of the substrate than the second end, the second surface comprising a metal ring, the balun circuit and the ground circuit being electrically connected to the oscillator arm.

2. The base station antenna according to claim 1, wherein the circumference of the metal ring equals to a wavelength of an operating frequency band; the oscillator arm are projected onto the second surface for forming a projection area partially overlap the metal ring.

3. The base station antenna according to claim 1, wherein the number of the oscillator arm is four; the plurality of oscillator arms comprises two first oscillator arms and two second oscillator arms; the two first oscillator arms and the two second oscillator arms are circularly arranged around the center of the substrate; the two first oscillator arms are oppositely disposed; the two second oscillator arms are oppositely disposed.

4. The base station antenna according to claim 3, wherein the balun support component comprises a first balun support member and a second balun support member; the first balun support member and the second balun support member cross each other; the second surface of the substrate is disposed on the first balun support member and the second balun support member; the first balun support member is disposed below the two opposite first oscillator arms; the second balun support member is disposed below the two opposite second oscillator arms; the first balun support member and the second balun support member respectively comprise a first support surface and a second support surface opposite to the first support surface; each first support surface comprises the ground circuit and the balun circuit electrically connected to the ground circuit; each second support surface comprises the ground circuit; the ground circuits of the first balun support member are disposed on two sides relative to the second balun support member; the balun circuit of the first balun support member is disposed on one side relative to the second balun support member; the ground circuits of the second balun support member are disposed on two sides relative to the first balun support member; the balun circuit of the second balun support member is disposed on one side relative to the first balun support member.

5. The base station antenna according to claim 4, wherein the substrate comprises a feeding perforation passing through the first ends of the oscillator arms; the first balun support member and the second balun support member respectively comprise two feeding protrusions; the ground circuits are respectively extended to the surfaces of the corresponding feeding protrusions; the feeding protrusions pass through the feeding perforation; the ground circuits are connected to the corresponding oscillator arms.

6. The base station antenna according to claim 4, wherein the height of the first balun support member and the height of the second balun support member are respectively less than a quarter of a wavelength of an operating center.

7. The base station antenna according to claim 1, wherein the wire lengths of the bending parts are respectively equal to a quarter of a wavelength of an operating center.

8. The base station antenna according to claim 1, wherein the plurality of bending parts comprises a first bending part, a second bending part, and a third bending part; the plurality of connecting parts comprises a first connecting part, a second connecting part, and a third connecting part; the first bending part, the first connecting part, the second bending part, the second connecting part, the third bending part, and the third connecting part are connected in order; the first bending part is farther from the substrate than the third bending part is; the length of the first bending part, the length of the second bending part, and the length of the third bending part are respectively equal to a quarter of a wavelength of an operating center.

9. The base station antenna according to claim 8, wherein a direction of an opening formed by the bending of the first bending part is different from a direction of an opening formed by the bending of the second bending part; the direction of the opening formed by the bending of the second bending part and a direction of an opening formed by the bending of the third bending part are the same.

10. The base station antenna according to claim 8, wherein a horizontal width of the circuit layout of the balun circuit gradually decreases from one end away from the substrate to one end close to the substrate.

11. The base station antenna according to claim 1, wherein a circuit width of the ground circuit decreases from one end away from the substrate to one end close to the substrate.

12. The base station antenna according to claim 11, wherein an edge of the ground circuit away from the center of the substrate is straight or stepped.

13. The base station antenna according to claim 1, wherein the oscillator arm is rhombus, rectangular or circular.

14. The base station antenna according to claim 1, wherein the substrate is a printed circuit board.

* * * * *